United States Patent [19]

Chaiken

[11] 4,387,655

[45] Jun. 14, 1983

[54] METHOD FOR CONTROLLED BURNOUT OF ABANDONED COAL MINES AND WASTE BANKS

[75] Inventor: Robert F. Chaiken, Pittsburgh, Pa.

[73] Assignee: The United States of America as represented by the Secretary of the Interior, Washington, D.C.

[21] Appl. No.: 376,852

[22] Filed: May 10, 1982

Related U.S. Application Data

[63] Continuation-in-part of Ser. No. 209,173, Nov. 21, 1980, abandoned.

[51] Int. Cl.[3] ..... F23D 1/00

[52] U.S. Cl. ..... 110/347; 110/218; 110/102

[58] Field of Search ..... 110/347, 102, 263, 232, 110/210, 214, 218, 229

[56] References Cited

U.S. PATENT DOCUMENTS

| | | | |
|---|---|---|---|
| 44,262 | 9/1864 | Thayer | 110/218 |
| 808,244 | 12/1905 | Korting | 110/218 |
| 2,407,849 | 9/1946 | Roth | 110/238 |
| 2,616,252 | 11/1952 | Robinson et al. | 110/347 |
| 4,098,007 | 7/1978 | Davis et al. | 432/72 |
| 4,184,436 | 1/1980 | Palm et al. | 110/102 |
| 4,285,283 | 8/1981 | Lyon et al. | 110/347 |

OTHER PUBLICATIONS

*Heat Balance in In Situ Combustion*, Bureau of Mines Report of Investigations, 4/29/1977 by Robert F. Chaiken.

*Controlled Burnout of Wasted Coal on Abandoned Coal Mine Lands*, Bureau of Mines Report of Investigations, by Robert F. Chaiken, 11/27/1980.

*Primary Examiner*—Henry C. Yuen

*Attorney, Agent, or Firm*—Thomas Zack; Donald A. Gardiner

[57] ABSTRACT

A method is provided for recovering energy from wasted coal by the steps of creating at least one channel through the wasted coal, igniting the wasted coal in said channel, subjecting said wasted coal, at least at said channel, to a negative pressure applied at a preselected point, connecting said wasted coal, at least at said channel, to a source of air remote from said preselected zone whereby air is induced through said ignited coal to burn said coal to produce hot gaseous products of combustion, and the hot gaseous products of combustion are drawn from said zone, and utilizing said hot gaseous products of combustion in a heat exchange relationship to recover the heat energy therefrom.

5 Claims, 10 Drawing Figures

PLAN VIEW OF MULTIPLE BOREHOLE SYSTEM

SIDE VIEW OF "BLIND" BOREHOLE SYSTEM

METHOD FOR CONTROLLED BURNOUT OF ABANDONED COAL MINES AND WASTE BANKS

This is a continuation-in-part of application Ser. No. 209,173, filed on Nov. 21, 1980 now abandoned.

This invention relates to methods of recovering energy from abandoned coal mines and waste banks and particularly to a method of combustion of wasted coals in place with utilization of the resultant heat energy in production of transportable energy such as electricity.

A significant economical consideration as well as a significant pollution problem of all past and current coal mining practices is the so called "wasted" coal. In general "wasted" coal falls in two catagories (a) underground coal in which due to the exigencies of the underground mining operations often contain as much coal as was extracted, and (b) above ground coal in coal refuse piles, which are accumulations on the surface of reject material from coal preparation plants and from underground mining operations, commonly known as spoil piles or boney piles.

The underground coal, generally in the form of coal pillars, frequently will become ignited and will burn for years unless controlled. The same is true of above ground waste piles. In both cases the uncontrolled burning of the coal is both a great waste of useful energy and a significant hazard to public health and safety because of the emission of toxic and obnoxious fumes and the destruction of residential and commercial buildings in the vicinity. Such fires once established can smolder for decades and their extinguishment by conventional methods of sealing, dig-out and quench is costly and hazardous.

The magnitude of the problem of extinguishing such fires can be appreciated by the fact that the cost estimates for extinguishing presently existing "waste" coal fires on abandoned lands in burning waste banks in the United States alone would be $468 million, and the cost of controlling existing fires in inactive coal deposites would be $75.6 million. This would of course merely be a fix for the present fire problem and would not remove the potential for further fires nor does it take into consideration the value of the "wasted" coal as a source of energy, which I believe to be in the same general area as the cost of extinguishing the fires, i.e. about $550 million.

I have developed a method of solving the problems inherent in these "wasted" coals both above and below ground. My invention eliminates both the environmental problems and the high cost of extinguishing such fires. By my practice an important new energy source, based upon the use of these wasted coals, is made available.

I have discovered that vast new quantities of energy are made available by in situ combustion of wasted coals under exhaust ventilation control conditions which allow for total management of the hot gases produced, followed by the utilization of the hot gases to produce process heat, steam or electricity. This solves once and for all the problems of fire and acid water formation which are inherent in every abandoned coal mine or waste bank. In addition it eliminates the problem of leaking of smoke, fumes and gases which have made prior positive pressure efforts at burn out unacceptable environmentally.

It has herefore been proposed to recover the energy from underground wasted coal by coal gasification through controlled burning underground. Unfortunately, this has not proven to be a satisfactory solution to the "wasted" coal problem for a variety of reasons. First it is difficult to control the rate of combustion to produce a sastisfactory fuel gas. Second it is equally difficult to control the gaseous products to prevent their escape in undesirable places because the controlled burning is done under positive pressure.

I provide a process for recovering energy from wasted coal comprising the steps of creating at least one channel through the wasted coal, igniting the wasted coal in the channel area, subjecting the wasted coal to a negative pressure applied at a preselected zone whereby the hot gaseous products of combustion are drawn to said zone, and utilizing said hot gaseous products of combustion in a heat exchange relationship to recover the heat energy therefrom. Preferably, the hot gaseous products of combustion are passed through an after burner where air or fluid fuel is added to produce substantially complete stoichiometric combustion of the hot gaseous products of combustion drawn to said point. The gaseous products of combustion leaving the heat exchange relationship are preferably cleaned and discharged to atmosphere. The Bureau of Mines Report of Investigations (RI) 8478 which I authored entitled "Controlled Burnout of Wasted Coal on Abandoned Coal Mine Lands" first published on Nov. 27, 1980, disclosed the subject matter of the invention involved in my earlier application.

In the foregoing general description, we have set out certain objects, purposes, and advantages of our invention. Other objects, purposes, and advantages of this invention will be apparent from a consideration of the following description and the accompanying drawings in which.

Figure 5A:
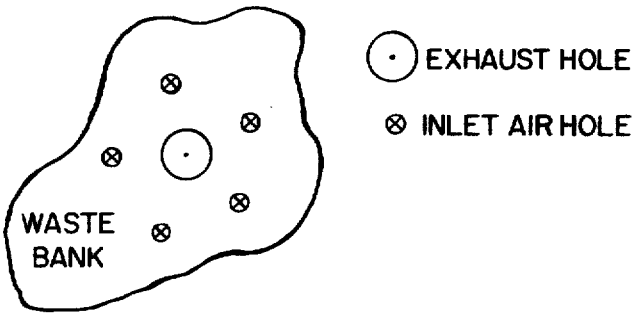
Figure 5B:
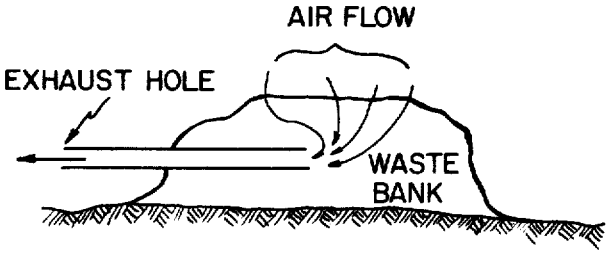
Figure 6:
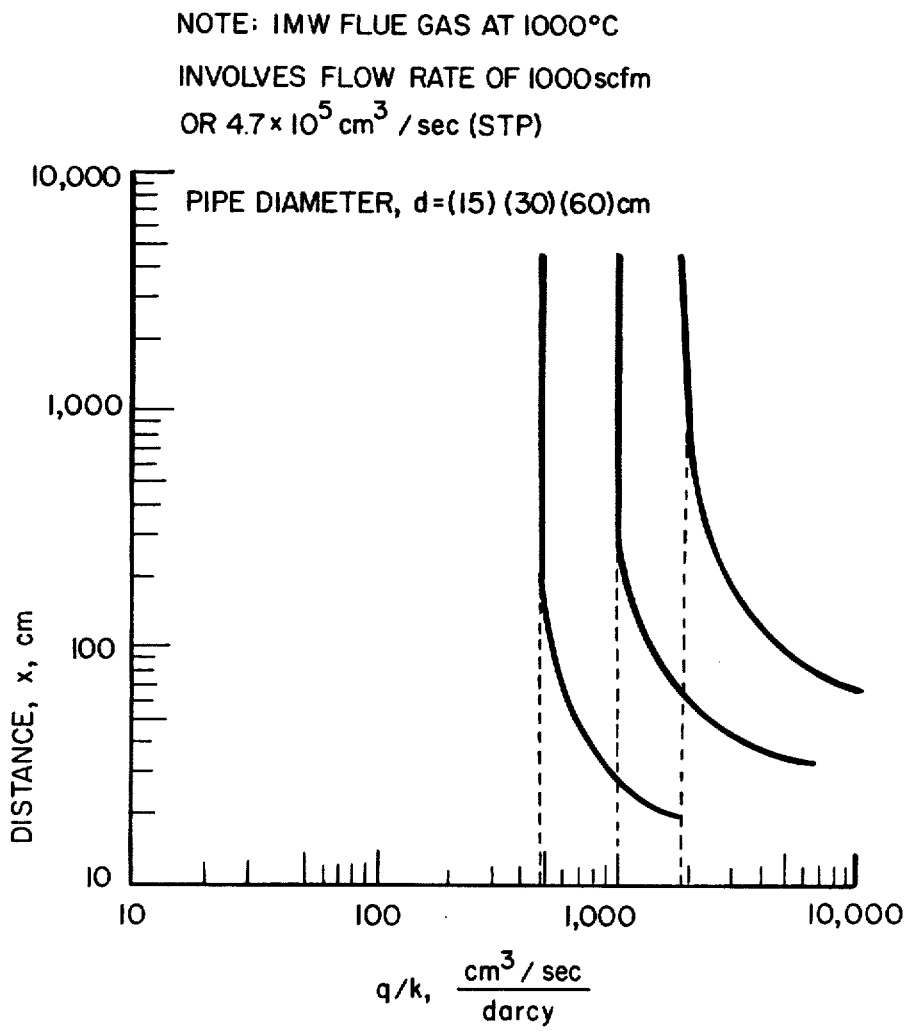
Figure 7:
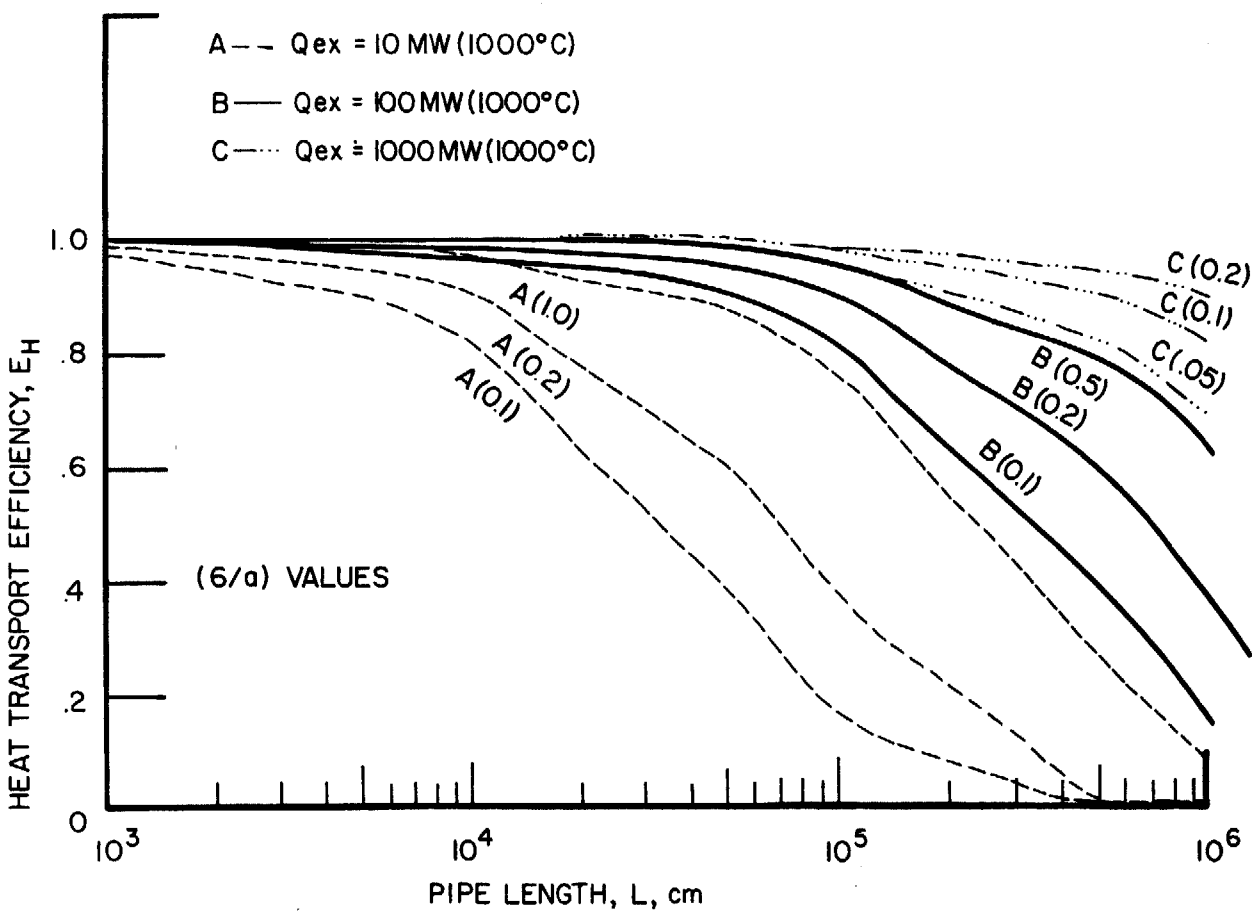
Figure 8:
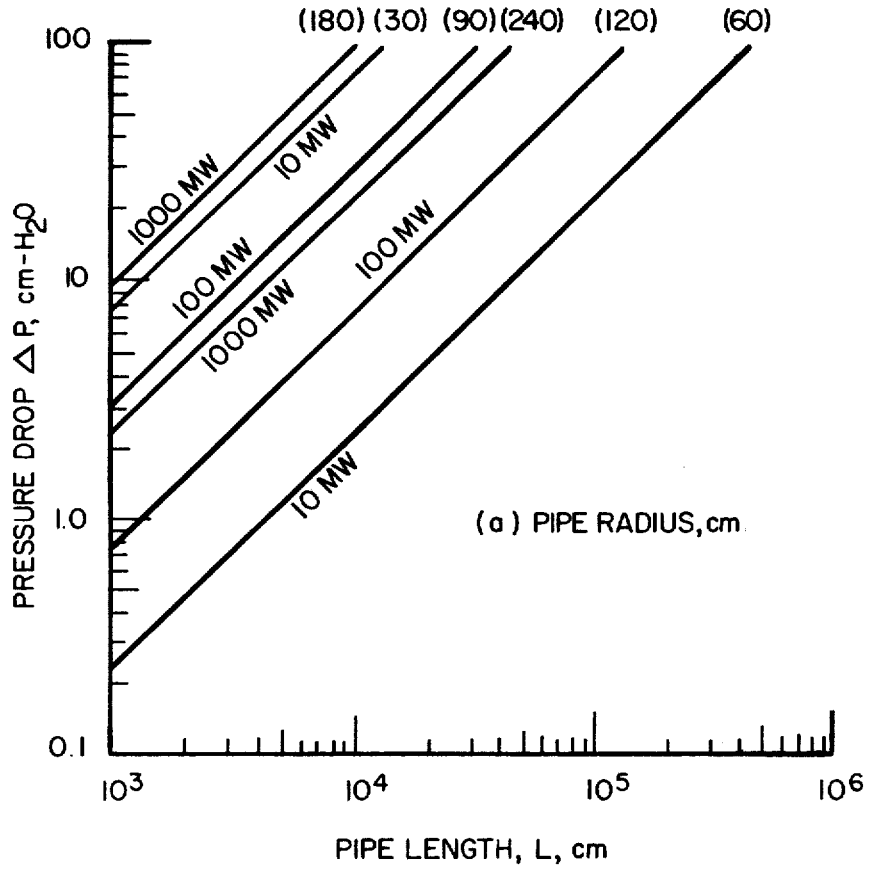
Figure 9:
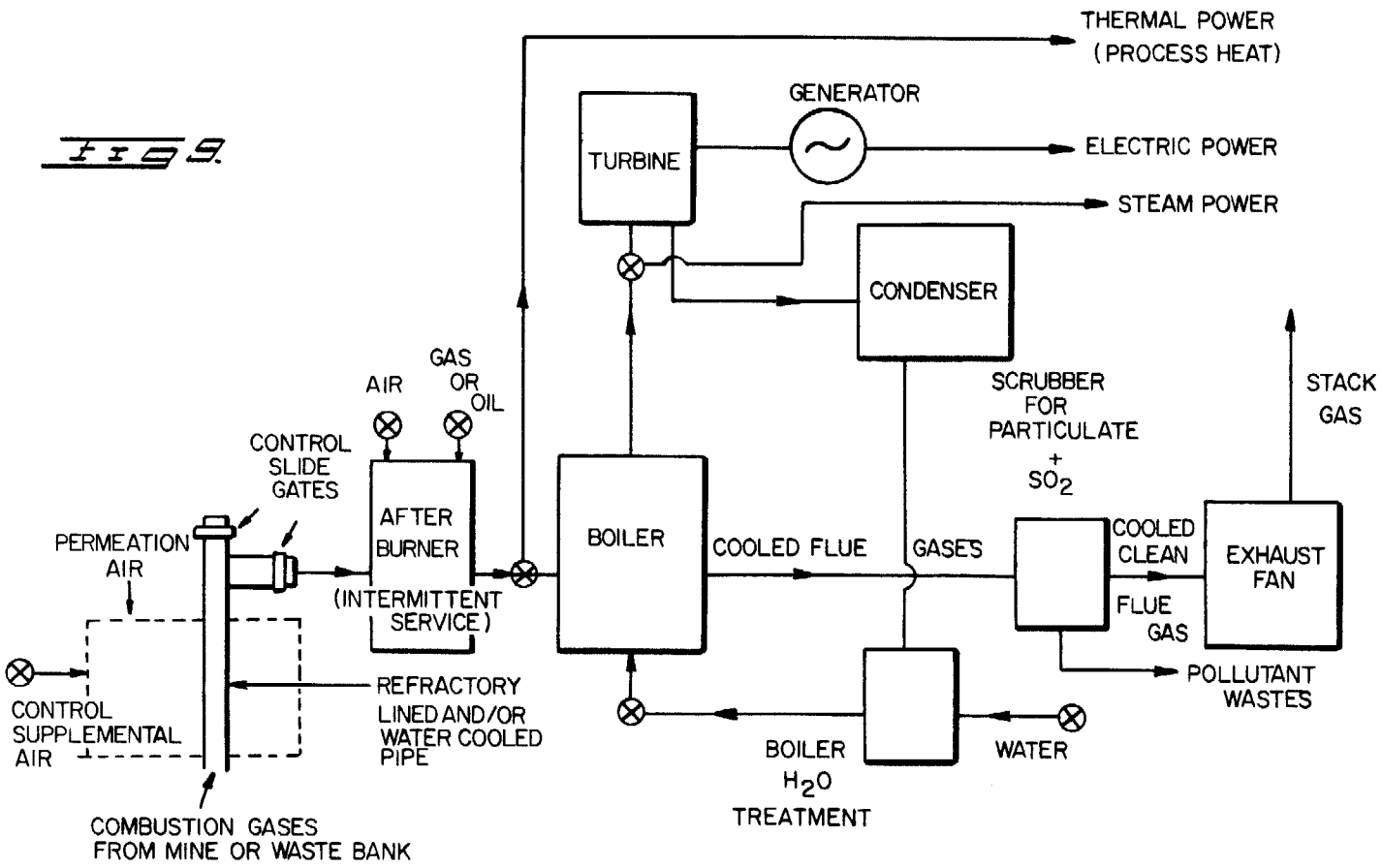

FIGS. 5*a* and 5*b* illustrate two possible borehole arrangements usable in this invention;

FIG. 6 is a graph of distance of negative pressure effect in a cool waste pile;

FIG. 7 is a graph of efficiency of heat transport in a pipe;

FIG. 8 is a graph of pressure drop vs. pipe distance for transporting thermal power; and FIG. 9 is a schematic flow diagram of a process of the invention.

The Bureau of Mines RI 8221 entitled "Heat Balance in In Situ Combustion" which I authored and first published on Apr. 29, 1977, discloses a mathematical analysis of the heat loss from an underground burning channel. The analysis thereat concluded the heat loss from in situ burning coal, even in thin seam (approximately 1 foot) should not seriously affect the thermal efficiency of an in situ combustion process. This RI (8221) does not disclose how the in situ combustion process is started or controlled, nor does it disclose any equipment or methods for utilizing or recovering the heat.

The present invention can perhaps be best understood by reference to controlled tests using the technique in rubbleized coal and solid coal.

Test 1

Figure 1:
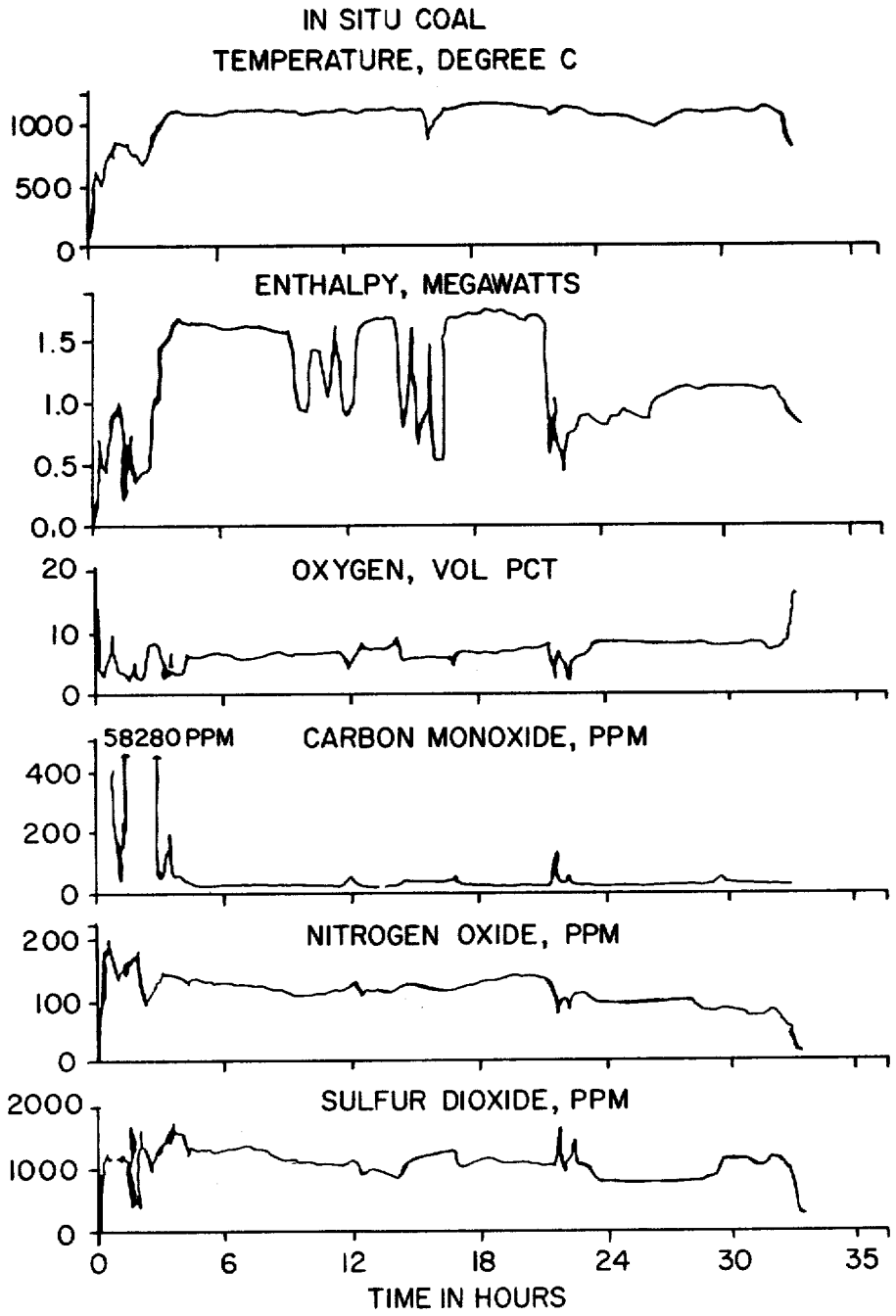
FIG. 1 is a data-time plot for simulated in situ burning of rubbleized coal.

Approximately 40 tons of coal rubble (stoker grade) were sealed in a trench to simulate an underground coal seam approximately 35 feet long, 8 feet high, and 6 feet wide. An axial channel of 1 square foot cross-section was formed in the coal rubble by means of a metal grate to define an in situ coal burning zone. One end of the channel was connected to an insulated exhaust pipe and fan, and the other end to a valved inlet air pipe. Two additional valved air inlet pipes were also positioned along the channel. The exhaust fan (15,000 scfm, 18 inch $H_2O$ head capacity) was connected to the insulated exhaust pipe to induce and maintain a negative pressure on the trench so as to induce an airflow into the channel through the inlet pipes to sustain combustion of the coal and at the same time exhaust the hot products of combustion from the channel in the coal bed. The test was operated continuously for 33 hours and during that time the thermal output of the in situ combustion process was readily controlled between 1.0 and 1.7 Mw, and the exiting combustion products were at very high temperature (about 1,600° C.). Except for $SO_2$ the exhaust gas was exceptionally clean in terms of low concentrations of CO, $NO_x$, and particulates. FIG. 1 shows data-time plots obtained in this experiment from measurements of the flue gas at a position some 20 feet downstream of the channel exit (i.e. after some afterburning with dilution air). It is noteworthy that while the observed $SO_2$ emission (1,100 ppm) is commensurate with the sulfur content of the coal (2 wt-pct), the observed $NO_x$ emission (110 ppm) is considerably lower than what might be expected on the basis of the fuel-nitrogen (1 = wt − pct). The $NO_x$ emission is actually about a factor of 5 less than values reported for pulverized fuel combustors. Likewise, the particulate emissions appeared visually to be quite small.

It is also noteworthy that during the entire test (ignition, steady burning, and cool down), the exhaust ventilation control system enabled total management of the combustion gas flow. Despite air leakage into the trench and total burnout and cave-in of a portion of the trench, no combustion products escaped to the atmosphere except through the exhaust system.

It is clear from this work that the controlled in situ burning of coal can be carried out efficiently, cleanly, and with total management of the heat and gases produced by following the practice of this invention.

It can also be anticipated from this test that the concept of in situ combustion at negative pressure would be a feasible approach to elimination of the environmental problems of "wasted" coal fires. Thus, in situ combustion methodology could be applied to accelerate the burning of abandoned mine and waste bank fires simultaneously with total management of their air pollutant emissions and with utilization of the thermal energy produced—eventually leading to complete burnout of the combustibles and elimination of their potential for acid water formation and reignition.

Test 2

In a second test a solid block of coal having a channel therein was enclosed in a second sealed trench and burned as in test 1. The results obtained in this test were similar to those in test 1, however, in this test the measured particulate emissions averaged only 0.008 lb/$10^6$ Btu over a 45 hour burning period. This would indicate that even better results may be expected from combusting solid in situ underground wasted coal depositions than from loose wasted coal.

It is interesting to calculate some ΔT values for reasonable estimates of the material parameters. Taking Pittsburgh seam coal at stoichiometric combustion, and using the following equations:

$$\Delta T = \frac{\left[\frac{H_C}{H_V} - \theta\right]\frac{\Delta H_V}{C_P}}{\phi + \frac{1}{X_c}}$$

where $O = m'_h/m'_o = x_w/x_c$, the ratio of mass of water to mass of coal in the refuse.

$\phi = m'_{air}/m'_e$, the stoichiometry of the coal combustion process (air/fuel ratio)

we would have $\phi = 12$ and $\Delta H_c = 7{,}600$ cal/g. The heat of evaporation of water is 540 cal/g. The value chosen for the heat capacity of the mixture in the burn zone (coal, combustion products, water vapor, inert material) is weighed towards a high water vapor content and assumed to be 0.5 cal/g-°C.

Figure 2:
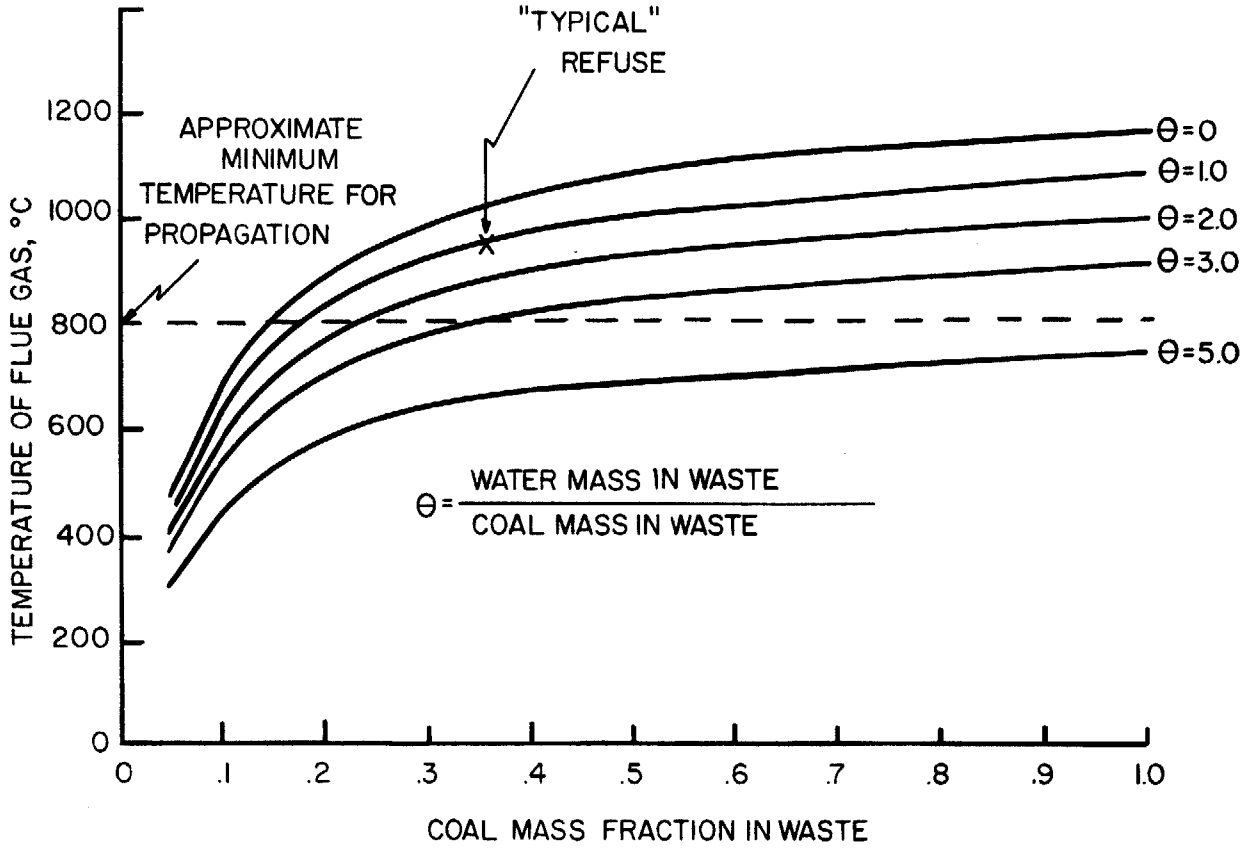
FIG. 2 is a graph of exhaust temperature as a function of coal and water content.

FIG. 2 shows the calculated combustion temperature for various coal and water contents of the refuse. The boundary line drawn at 800° C. in FIG. 2 is a "guesstimate" of the minimum temperature required for rapid chemical reactions which would insure self propagating combustion. A "typical" refuse pile containing 35 pct combustible and an equal amount of water falls into the region of sustained combustion yielding an exhaust gas of almost 950° C. (1,740° F.). These calculations indicate that sustained combustion can occur in refuse containing substantial quantities of water (2 to 3 times the coal content). This is consistent with the fact that waste bank fires continue to burn despite their exposure to the elements and often despite attempts to extinguish them by saturation sprinkling. The calculated results also suggest that most coal refuse piles have enough fuel to sustain a fire provided that sufficient air can be drawn into the interior of the piles.

Heat Loss from Channel Burning in Abandoned Coal Mines

Whereas propagating coal refuse fires results in the accumulation of heat in inert material which is always intimately mixed with the fuel (i.e., internal to the burning system) the geometry of abandoned amine fires results in heat accumulating in roof and floor strata which are external to the coal burning system. Thus, the heat which is conducted away from the burning coal must now be considered as an energy loss which will affect the exhaust temperatures, and could conceivably extinguish burning under certain conditions of seam thickness and channel dimensions. This problem of heat loss during channel burning in a coal seam has received mathematical treatment by the U.S. Bureau of Mines and the results pertinent to the problem of burnout of abandoned mine fires are summarized in this section.

Figure 3:
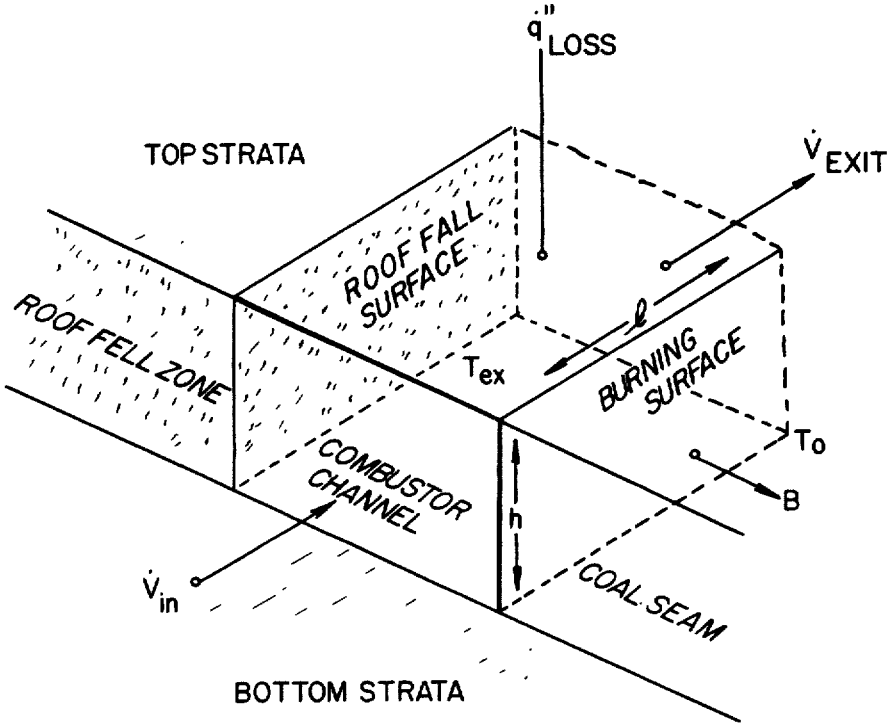
FIG. 3 is a sketch of a model coal seam combustion channel.

The model of channel burning considered is shown in FIG. 3. Here a rectangular channel of length (l) and width (w) in a coal seam of thickness (h) moves at a linear surface burning rate (B) through the seam. A constant ventilating air and exhaust gasflow occurs along l. The effective channel width remains constant by the process of continuous coal burning on one side of the channel and continuous or periodic roof fall along the opposite side of the channel. Heat is lost from the system by thermal conduction to the roof and floor strata, but only while the strata define the upper and lower boundaries of the channel. Consideration of the quasi-steady-state energy balance during the effective exposure time period leads to:

$$(\Delta T)^{-1} = \frac{C_P(\phi + 1)}{\Delta H_c} + \frac{4\lambda}{\rho_s \Delta H_c h} \sqrt{\frac{w}{\pi \kappa B}}$$

where $\lambda$ = the thermal conductivity of the strata (assumed constant), $\kappa$ = the thermal diffusivity of the strata, $\rho s$ = the density of the strata, and the remaining symbols have the same definitions given in the previous section.

The fractional heat lost $E_L$ and the fraction of energy transmitted in the exhaust $E_H$ are given by the expressions:

$$E_L = \frac{4\lambda \Delta T}{\rho_s \Delta H_c h} \sqrt{\frac{w}{\pi \kappa B}} \text{ and } E_H = \frac{C_P(\phi + 1)\Delta T}{\Delta H_c}$$

Figure 4:
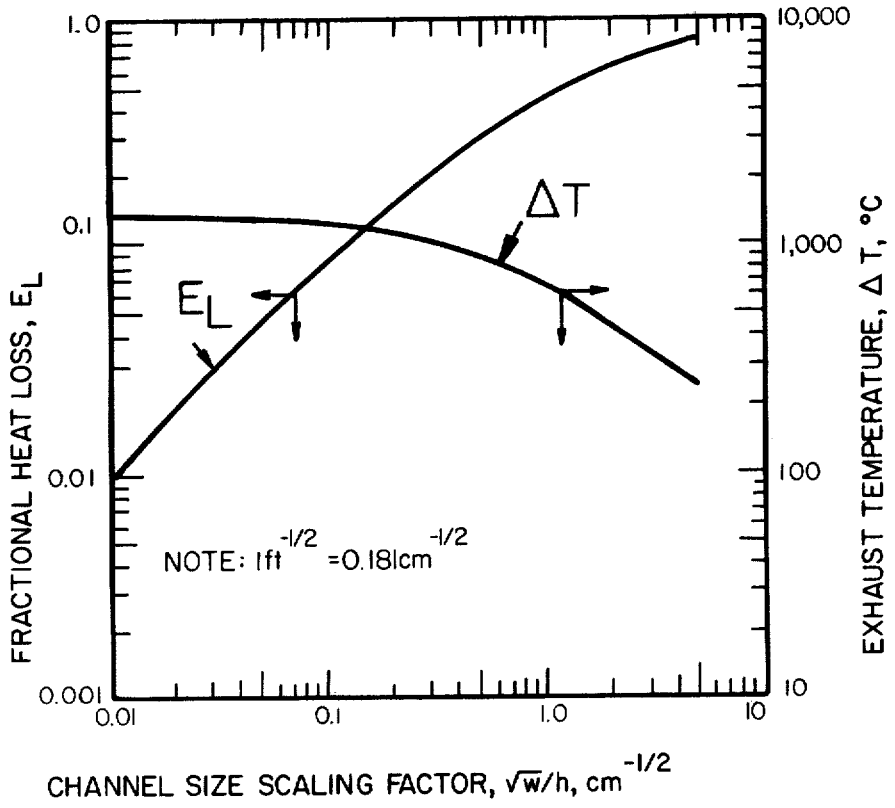
FIG. 4 is a graph of fractional heat loss and exhaust temperature with channel size scaling factor.

The equation $$E_L = \frac{4\lambda \Delta T}{\rho_s \Delta H_c h} \sqrt{\frac{w}{\pi \kappa B}}$$

indicates that the fractional heat loss increases with decreasing seam thickness and with increasing channel width. FIG. 4 is a plot of both $E_L$ and $\Delta T$ versus the scaling factor $\sqrt{w/h^2}$ for a stoichiometric air/fuel ratio, $\phi = 12$, and values of the material parameters which are given in table 1. Again, assuming a criterion of $\Delta T > 800°$ C. for self-propagated burning, a heat loss as high as 40 pct could be sustained at a value of $\sqrt{w/h^2} \simeq 0.7$ cm$^{-1}$. Thus for 180 cm (6 feet) thick seam, the effective width of the burning channel must be less than $1.6 \times 10^4$ cm (550 feet), which is most likely to be the case. It is interesting to note that the temperature criterion (>800° C.) would be met even for seams as thin as 30 cm (1 foot). As shown in FIG. 4, a channel exhaust temperature of 1,000° to 1,200° C. (1,800° to 2,200° F.) should be expected, which is in good agreement with the combustion results obtained in some underground coal gasification trials.

TABLE 1

| Input data for numerical calculations | | |
|---|---|---|
| $\lambda$ | cal/cm-sec-°C. | $4 \times 10^{-4}$ |
| B | cm/sec | $2 \times 10^{-4}$ |
| $\Delta H_c$ | cal/g | $7 \times 10^3$ |
| $\rho_s$ | g/cm$^3$ | 1.3 |
| $C_P$ | cal/g-°C. | 0.4 |
| $\kappa$ | cm$^2$/sec | $10^{-4}$ |

Effective Burn Control Volume in a Waste Bank

To achieve negative pressure burning according to this invention in a porous waste bank it is necessary to suck on a region inside the bank using an exhaust fan operating through a piping system inserted into the bank. Two possible approaches are depicted schematically in FIG. 5. FIG. 5*a* depicts the use of multiple inlet air boreholes surrounding a single exit borehole. FIG. 5*b* depicts the use of a single exit borehole with air being drawn through the surface of the bank ("blind" borehole method). The question is what volume of waste bank can be aerated by exhausting at the exit borehole. This will establish the effective volume of the bank under in situ combustion control.

A simple approach to estimating this volume is to apply Darcy's Law to the "blind" borehole geometry with the assumption that the gasflow within the bank is uniform, steady, and converges spherically towards the tip of the exit borehole.

Darcy's equation for 1-dimensional steady flow through a porous medium can be written as:

$$\dot{q} = \frac{kA}{\mu}(dP/dx)$$

Where $\dot{q}$ = the gas volume flow rate in cm$^3$/sec.

k = the permeability of the porous medium in Darcys, $\mu$ = the gas viscosity in centipoise, A = the effective cross-sectional flow area in cm$^2$, and dP/dX = the pressure drop across the bed in atm/cm.

A steady flow at the tip of the blind borehole, and uniform convergent flow in the bank requires that q be constant across a spherical cross-sectional area situated at a distance x from the borehole. If $\beta$ is the solid angle in steradians which defines the flow region, the cross-sectional area as a function of x is:

$$A = 4\pi\beta x^2 \text{ and } \dot{q} = 4\pi\beta \frac{k}{\mu} x^2 \frac{dP}{dx}$$

With a constant $\dot{q}$, $\beta$ and $(k/\mu)$, the equation $$\dot{q} = 4\pi\beta \frac{k}{\mu} x^2 \frac{dp}{dx}$$

can be integrated to yield:

$$\frac{1}{x_1} - \frac{1}{x_0} = \frac{4\pi\beta}{\dot{q}} \frac{k}{\mu}(P_0 - P_1)$$

For the porous flow situation being considered, the integration limits can be taken as $P_1(x_1) = 1$ atm (ambient pressure)

$P_o(x_o = d)$ = maximum negative pressure at one borehole diameter distance, d, away from the tip of the borehole.

This yields the following expression for the affected distance x in the waste bank $$\frac{1}{x_1} = -4\pi\beta\Delta P\left(\frac{k}{\mu q}\right) + \frac{1}{d}$$

where $\Delta P$ = the effective vacuum (a positive quantity) that can be applied at the exit borehole.

Numerical solutions for $x_1$ with various sized boreholes are shown in FIG. 6, or the case where $\mu = 0.02$ centipoise (i.e., air), $\Delta P = 0.1$ atm (i.e., 1.47 psi or 38.6-in $H_2O$ vacuum), and $\beta = 0.5$ (i.e., a hemispherical flow region). The numerical solutions in FIG. 6 are asymptotic.

To achieve large burn volumes, x, would have to be large (i.e. > 300 cm or 10 feet), and q/k close to the minimum value for which solutions to the last equation are obtained. In those cases $$(\dot{q}/k)_{cr} = \frac{4\pi\beta\Delta Pd}{\mu}$$

is the asymptotic limit for large x, and defines the achievable practical flow rate. For example, in a waste bank having dimensions much larger than d, and having a permeability of $10^3$ Darcys (approximately 10 times that of a pile of sand), an exhaust flow rate of $10^6$ $cm^3$/sec (2,130 scfm) could be achieved with a 30-cm (1-foot) diameter exit borehole. Larger flow rates could be achieved, but only by sacrificing the effective burn volumes in the bank. For example, an exhaust flow three times greater (6,390 scfm or $3\times10^6$ $cm^3$/sec) from the same bank and borehole leads to a value of $x_1=100$ cm (or 3 feet). Thus, a blind borehole would have to be positioned some 3 feet below the surface of the bank in order to maintain a negative pressure burning region, i.e., to draw in sufficient air for complete combustion of the waste and exhaustion of the hot gaseous products.

This simple approach to porous flow does not take into account the effects of changing permeability with increasing zonal burnout or the effects of nonuniformities either in the permeability or the gasflow, all of which are expected to occur in an actual burnout. However, the calculations do indicate that the maintenance of a negative pressure combustion zone in a porous bank should be feasible, provided that sufficient suction is available from the exhaust fan.

Effective Burn Control Volume in an Abandoned Mine

The burn control volume for an abandoned mine, as in controlled burnout of a waste bank, depends upon the airflow induced by the exhaust fan system. If all the original mine entries and stoppings remained in good condition, simple ventilation network calculations would yield reasonable estimates of the possible airflow. This, of course, is hardly to be expected for old workings on fire where stopping and roof collapse have undoubtedly occurred. However, since one must start some place, the abandoned mine fire geometry for the current purposes is idealized as the propagating channel burn depicted in FIG. 3. This will enable some estimate of the relationship between channel size and ventilation fan requirements. The calculations presented draw heavily on U.S. Bureau of Mines results previously reported in connection with an in situ coal combustion and coal mine fires.

Referring to FIG. 3, the total mass rate of coal burning coal is $\dot{M}_t=\rho_s BA_s$, where $\rho s$ = the coal density, B = its constant linear burning rate (identical to the rate of movement of the channel through the coal seam), and $A_s$ = hl is the area of the burning coal surface. For a stoichiometry defined by an air/fuel ratio of $\phi$, the total volumetric exhaust flow rate is $$q = \frac{\rho_s B(\phi+1)A_s}{\overline{M}/\overline{V}}$$

where $\overline{M}$ = the average gram molecular weight of the gaseous combustion products and $\overline{V}$ = their specific molar volume.

From previous U.S. Bureau of Mines studies the pressure drop across the burning channel is estimated to be $$\Delta P = \frac{\alpha l \dot{Q}_{ex}^2}{A_x{}^{5/2}} \text{ cm} - H_2O$$

where l (cm) = the channel length, $A_x$ ($cm^2$) = its cross-sectional area $\dot{Q}_{ex}$ = the thermal power level of the exhaust flow in kilowatts, and $\alpha$ = an empirical constant equal to 0.17 for the given parameter units.

Since $\dot{Q}_{ex}=\rho_s BA_s\Delta H_c$ where $\Delta H_o$ is the heat of combustion of coal, we obtain:

$$\frac{\Delta P}{l} = \alpha(\rho_s B\Delta H_c)^2 \frac{A_s}{A_x{}^{5/2}} \text{ and } \Delta P = \alpha(\rho_s B\Delta H_c)^2 \frac{l^3}{h^{\frac{1}{2}}v^{5/2}}$$

For the coal parameters in Table 1 (keeping in mind that for $\alpha=0.17$, the $\Delta H_c$ of $7\times10^3$ cal/g must be expressed as 239 KW-sec/g), and assuming that $h^{\frac{1}{2}}w^{5/2}\simeq w^3$ (which would be exactly the case for a square channel with $h=w=A_x{}^{\frac{1}{2}}$), the equation $$\Delta P = \alpha(\rho_s B\Delta H_c)^2 \frac{l^3}{h^{\frac{1}{2}}v^{5/2}} \text{ becomes:}$$

$$\Delta P = 6.6\times10^{-4}\left(\frac{l}{w}\right)^3 \text{cm} - H_2O$$

Here we see that the pressure drop is very sensitive to the ratio of channel length to channel width. For example, an l/w=25 would require a $\Delta P$ of 10.3 cm-$H_2O$ (0.15 psi) which should be readily achieved with conventional exhaust fans. However an l/w=75 leads to a $\Delta P$ of 278 cm-$H_2O$ (4.2 psi) which would pose a more severe constraint on fan size.

To relate the equation $$\Delta P = 6.6\times10^{-4}\left(\frac{l}{w}\right)^3 \text{cm} - H_2O$$

to burning volume, we need to know the effective width of the burning channel, a matter which is probably site selective. A reasonable "guesstimate" would be w no less than one-half the seam thickness, which for a 180-cm (6-feet) thick bed and a nominal $\Delta P$ of 10.3 cm-$H_2O$, would lead to a ventilated burn channel length of 2,250 cm (75 feet).

The exhaust volume is given the equation $$\dot{q} = \frac{\rho_s B(\phi+1)A_s}{\overline{M}/\overline{V}}$$

which for reasonable material parameter values ($\phi=12$; $\overline{M}=30$ g/mole; $\overline{V}=2.24\times10^4$ cm$^3$/mole (STP); also see table 1) yields $$\dot{q}=2.52\ A_s=2.52\ (hl)\ cm^3/sec\ (STP)$$

For the channel burning case above where h=180 cm. l=2,250 cm $\Delta P=10.3$ cm-$H_2O$, the volumetric flow rate would be $10^6$ cm$^3$/sec (STP) or 2,190 sefm. well within the range of conventional exhaust fans. At 1,000° C. the power level generated by the exhaust flow would be ~2 Mw. The fan air horsepower, which is the product of $\Delta P$ and $\dot{q}$ multiplied by an appropriate conversion factor, would in this case be 1.4 ahp, again a very nominal value. The fan power requirements are discussed in somewhat greater detail in the next section. These theoretical results are based on a highly idealized in situ burning geometry. In abandoned mines, channel blockages and roof cave-ins could easily affect the ventilation pressure drop and the ventilation airflow to the burning coal surface; however, on the basis of the idealized geometry, there would appear to be no fundamental difficulties in achieving ventilation controlled burnout of the combustible in an abandoned mine.

Fan Power Requirements for Burnout Control

While the design of an exhaust fan ventilation system for burnout control will have to be site selective, it is useful to establish some general requirements in engineering units for fan capacity and motor size. This is necessary to elucidate the value of the energy conversion efficiency that is available through in situ combustion techniques.

We consider coal to have a heating value of 10,000 Btu/lb (5.55 kcal/g) and a nominal carbon to hydrogen ratio of unity. The complete combustion reaction can be approximated by $$\underbrace{CH}_{\substack{1\text{ mole}\\ \text{coal}}} + \underbrace{1.25O_2 + 4.62N_2}_{5.87\text{ moles air}} \quad \underbrace{CO_2 + H_2O + 4.62N_2}_{6.12\text{ moles exhaust}}$$

From molecular weight considerations, it is readily seen that 0.388 lb of air (5.87 moles or 4.7 scf) is required to combust 0.0286 lb of coal. This leads to 6.12 moles of gaseous exhaust (4.9 scf) having a sensible heat content of 58.4 Btu/ft$^3$ (STP).

We now consider an exhaust thermal power output of 1 Mw for $5.7\times10^4$ Btu/min). This requires an exhaust flow rate of combustion products of 976 scfm and a coal combustion rate of 5.7 lb/min.

The air horsepower (ahp) required to drive this exhaust flow is given by $$ahp = \frac{\Delta P(\text{in} - H_2O) \times \dot{q}(scfm)}{6348}$$

If we assume that a relatively high pressure drop of 100 in-$H_2O$ (3.8 psi) will be required to ventilate the required burn control volume, the fan air horsepower requirements for a 1 Mw thermal output is 15.4 ahp. With 70 pct fan efficiency, the electrical power requirement for the fan motor will be 22 hp (or 0.0164 Mw). Assuming no losses or additional energy expenditure (eg. for scrubbing systems, thermal conversion systems, etc), the energy recovery for the in situ combustion technique would be $$\frac{\text{thermal energy output}}{\text{electrical energy input}} = 61$$

This factor, which is independent of $\dot{Q}_{ex}$, is considerably greater than the value of 3 to 4 reported for underground coal gasification. Even when a thermal to electrical energy conversion efficiency of about 30 pct is taken into account, the energy recovery factor is still quite large, i.e.

$$\frac{\text{thermal energy output}}{\text{thermal equivalent electrical energy input}} = 20$$

Thermal losses would, of course, lower the recovery factor by a proportional amount, but on the other hand, decreased fan pressure requirements (i.e. $\Delta P<100$ in-$H_2O$) would increase the recovery factor proportionally.

Surface Transport on Hot Exhaust Products

So far the technical discussions have centered on the in situ combustion process itself and not on the utilization of heat produced during burnout. In general, the approach to utilization of heat would be much the same as almost any high-temperature (1,000° C.), ambient-pressure flue gas (eg. to supply process heat, utility steam, electricity generation) except that utilization or conversion would have to be on-site. This is because it is not feasible to transport heat energy over long distances. However, the question still arises as to what distance would be defined as on-site, or how far the hot flue gas can be moved before thermal losses, and exhaust pipelines cost become prohibitive. In essence this will define the maximum distance between the exit borehole and the energy utilization facility. Estimates of this maximum distance and its parametric relationship to thermal power level and pipeline size are readily obtained from considerations of heat loss and pressure drop through the surface pipe system.

For the heat loss calculation, we consider the steady-state radial flow of heat into a pipe wall of thickness o whose inner surface is maintained at constant temperature $T_a$, and whose outer surface temperature is at constant ambient temperature $T_o$. For a pipe wall having constant thermal physical properties, the rate of heat flow per unit length of pipe $\dot{Q}'_a$ is given by $$\dot{Q}'_a = \frac{2\pi_p\lambda T_a - T_o}{\ln(1 + \delta/a)}$$

where $\lambda p$=the thermal conductivity of the pipe wall,
a=the inside radius of the pipe,
and
$\delta$=the wall thickness.

For a small section of pipe having a length of $\Delta L=(L_2-L_1)$, and an axial temperature difference defined by $T_a(L_1)=T_1$ and $T_a(L_2)=T_2$, the total heat rate of heat loss to the wall will be determined by the equation above using an average inner surface temperature $$T_a=(T_1+T_2)/2=T_1-\Delta T/2$$

for the section $\Delta L$. Here, $\Delta T=T_2-T_1$ is the change in temperature across the section $\Delta L$. Assuming a uniform and well-mixed hot gasflow through the pipe, $\Delta T$ is also the change in temperature of the gas due to the wall heat loss.

The energy balance for the pipe section ΔL is then $$\frac{2\pi\lambda}{\ln(1+\delta/a)}(T_1 - T_o - \Delta T/2)(\Delta L) = -\dot{m}_g C_p(\Delta T)$$

where $\dot{m}_g$ = the mass flow rate of the gas, and $C_p$ = its specific heat.

Solving for ΔT/ΔL in the zero limit of ΔL yields a simple differential equation $$dT/dL = \frac{-2\pi\lambda p(T_1 - T_o)}{\dot{m}_g c_p \ln(1+\delta/a)}$$

for the change in gas temperature with pipe length. Integrating between the limits $T(L=O)=T_{ex}$, the exit borehole exhaust temperature, and $T(L)=T_L$, the gas temperature at distance L along the pipe, we obtain $$\frac{T_L - T_o}{T_{ex}T_o} = \exp\left[-\frac{2\pi\lambda_p L}{\dot{m}_g C_p \ln(1+\delta/a)}\right]$$

Recognizing that $\dot{Q}_L = \dot{m}_g C_p(T_L - T_o)$, it is seen that the lefthand side of the above equation is also the friction of the exhaust thermal power flowing through the pipe distance L (i.e., $E_H = Q_L/Q_{ex}$). This last equation can also be written as $$E_H = \exp\left[-\frac{2\pi\lambda_p(T_{ex} - T_o)L}{\dot{Q}_{ex}\ln(1+\delta/a)}\right]$$

Here we see that the thermal transport efficiency increases exponentially with increasing power level and decreasing gas temperature. FIG. 7 depicts several curves of $E_H$ vs L for various power levels of flue gas at $T_{ex}$ = 1,000 C (1,830° F.), and various values of the pipe size factory δ/a. As expected, the transport efficiency depends strongly on $\dot{Q}_{ex}$, δ/a and L.

Assuming that a value of δ/a = 0.1 to 0.2 might be reasonable we see that 10 Mw, 100 Mw, and 1,000 Mw power levels could be effectively transported $10^4$ cm (328 feet), $10^5$ cm (3,280 feet), and $10^6$ (32,800 feet) respectively, before heat loss becomes excessive.

Considering pipe heat loss alone, the combustion products from a controlled burnout of "wasted" coal could be transported an adequate distance for on-site utilization, particularly at the higher power levels. However, the pressure drop associated with a desired gasflow rate or thermal power level is another important constraint.

To estimate the pressure drop ΔP for a given hot gasflow we considered the pipe flow equation $$\Delta P = \frac{f}{2}\rho v^2 \frac{A_w}{A_x}$$

where ρ and v = the gas density and gas velocity, respectively, $A_w$ and $A_x$ = the pipe wetted surface area and cross-sectional area, respectively, and f = a wall friction factor which is dimensionless when the parameter values are expressed in the cgs system of units.

For a circular pipe $A_w/A_x = 2\pi aL/\pi a^2$, and recognizing that the total steady state mass flow rate $m_g$ is $$\dot{m}_g = \rho v A_x = \frac{\dot{Q}_{ex}}{C_p(T_{ex} - T_o)}$$

the equation $$\Delta P = \frac{f}{\rho}\left[\frac{\dot{Q}_{ex}}{C_p(T_{ex} - T_o)}\right]^2 \frac{L}{a^5}$$

becomes

Here, we see the pressure drop is very sensitive to the pipe radius and thermal power level. ΔP decreases with increasing 'a' and decreasing $\dot{Q}_{ex}$. On the other hand the thermal transport efficiency, $E_H$, increases with decreasing 'a' and increasing $\dot{Q}_{ex}$. Thus both ΔP and $E_H$ must be considered together in setting specifications for the surface heat transport pipe.

The last equation is plotted in FIG. 8 as ΔP vs L for some power levels of interest assuming f = 0.01 (i.e. smooth wall, turbulent flows). For a 100 cm-$H_2O$ (36 in $H_2O$) pressure drop and a $10^5$-cm (3,280-foot) distance, a 10 Mw, and 100 Mw, 1,000 Mw power level would require a pipe radius of 45 cm, 113 cm, and 288 cm, respectively. An 80 pct heat transport efficiency under these same conditions would require the wall thickness of the pipe to be approximately 50 cm, 10 cm, and 2 cm, respectively.

From these considerations, it can be expected that piping cost for surface transportation of high temperature flue-gas will be significant.

In FIG. 9 we have schematically illustrated a plant for utilization of my invention.

In the foregoing specification I have set out certain preferred practices and embodiments of my invention, however, it will be understood that this invention may be otherwise embodied within the scope of the following claims.

I claim:

1. A process for recovering energy from in situ wasted coal located at or adjacent to the area from which mined comprising the steps of:

(a) creating at least one channel through the in situ wasted coal without removing the wasted coal from its location at or adjacent to the mining area;

(b) igniting the wasted coal in said channel while at the same location to cause subsurface in situ combustion to occur;

(c) activating gas control means to subject said wasted coal, at least in said channel, to a controlled negative gaseous pressure drop relative to ambient gaseous pressure applied to a preselected zone;

(d) connecting said wasted coal, at least in said channel, to a source of air remote from said preselected zone to induce the air to permeate through the wasted coal to the channel and thereby in step (b) produce hot gaseous products of combustion, said products being drawn to said zone;

(e) drawing the hot gaseous products of combustion through an afterburner from the preselected zone, air and fuel being added thereto in said afterburner in an amount sufficient to produce essentially complete stoichiometric combustion of the gaseous products of combustion; and (f) thereafter utilizing said hot gaseous products of combustion in a heat exchange relationship to recover the heat energy therefrom.

2. The process of claim 1 wherein:

(g) the hot gaseous products of combustion utilized in step (e) are used in a heat exchange relationship to produce one of steam, hot water, electricity, and processed heat.

3. The process of claim 1 wherein:

(h) gaseous products of combustion leaving the heat exchange relationship, step (f), are cleaned of particulates and $SO_2$ and thereafter exhausted to atmosphere.

4. The process of claim 4 wherein:

(i) step (h) utilizes an aqueous scrubber to clean the particulates.

5. The process of claim 1 wherein:

(j) step (d) comprises the placement of at least one air inlet conduit from the surface into the wasted coal to provide for the entrance of air thereinto.

* * * * *